US011168940B2

(12) United States Patent
Boland et al.

(10) Patent No.: US 11,168,940 B2
(45) **Date of Patent: *Nov. 9, 2021**

(54) ADJUSTABLE INTERLACING OF DRYING ROLLERS IN A PRINT SYSTEM

(71) Applicants: Stuart J. Boland, Denver, CO (US); Dilan Nirushan Fernando, Thornton, CO (US); Scott R. Johnson, Erie, CO (US); Casey E. Walker, Boulder, CO (US)

(72) Inventors: Stuart J. Boland, Denver, CO (US); Dilan Nirushan Fernando, Thornton, CO (US); Scott R. Johnson, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,279

(22) Filed: Jun. 23, 2020

(65) Prior Publication Data

US 2020/0318902 A1 Oct. 8, 2020

Related U.S. Application Data

(63) Continuation of application No. 16/046,321, filed on Jul. 26, 2018, now Pat. No. 10,731,921, which is a (Continued)

(51) Int. Cl.

| | |
|---|---|
| ***F26B 13/18*** | (2006.01) |
| ***F26B 13/14*** | (2006.01) |
| ***B41J 11/00*** | (2006.01) |

(52) U.S. Cl.
CPC ..... *F26B 13/18* (2013.01); *F26B 13/14* (2013.01); *B41J 11/002* (2013.01)

(58) Field of Classification Search
CPC . F26B 13/18; F26B 13/14; F26B 11/18; B41J 11/002
(Continued)

(56) References Cited

U.S. PATENT DOCUMENTS

| | | | | |
|---|---|---|---|---|
| 9,605,900 | B2 * | 3/2017 | Boland | F26B 13/18 |
| 9,908,342 | B1 * | 3/2018 | Boland | B41J 11/002 |

(Continued)

FOREIGN PATENT DOCUMENTS

| | | | | |
|---|---|---|---|---|
| JP | 2014184711 | A * | 10/2014 | B41F 3/52 |
| JP | 2016205813 | A * | 12/2016 | F26B 13/18 |
| JP | 6142942 | B2 * | 6/2017 | F26B 13/14 |

*Primary Examiner* — Stephen M Gravini
(74) *Attorney, Agent, or Firm* — Duft & Bornsen, PC

(57) ABSTRACT

Systems and methods for adjustable interlacing of drying rollers in a print system. One system is an apparatus that includes first rollers that conduct heat from a heat source, and dry a web of print media as the web travels over a front side of the first rollers in a first direction. A last roller of the first rollers turns the web in a second direction. The apparatus also includes second rollers disposed a distance above the first rollers and that transport the web in the second direction. The apparatus further includes a movement mechanism that reduces the distance between the second rollers and the first rollers to cause the second rollers to occupy spaces between the first rollers so that the web traveling in the second direction contacts a back side of the first rollers to further dry the web.

27 Claims, 9 Drawing Sheets

Related U.S. Application Data continuation of application No. 15/431,546, filed on Feb. 13, 2017, now Pat. No. 10,060,675, which is a continuation of application No. 14/693,020, filed on Apr. 22, 2015, now Pat. No. 9,605,900.

(58) Field of Classification Search
USPC ..... 162/359.1; 34/117, 620
See application file for complete search history.

(56) References Cited

U.S. PATENT DOCUMENTS

| | | | | |
|---|---|---|---|---|
| 10,060,675 | B2 * | 8/2018 | Boland | F26B 13/18 |
| 10,065,433 | B1 * | 9/2018 | Boland | B41J 11/002 |
| 10,118,411 | B2 * | 11/2018 | Yoshinuma | B41J 11/002 |
| 10,227,199 | B2 * | 3/2019 | Boland | B65H 23/32 |
| 10,731,921 | B2 * | 8/2020 | Boland | F26B 13/14 |
| 2014/0232797 | A1 * | 8/2014 | Onodera | B41F 23/042 347/102 |
| 2020/0318902 | A1 * | 10/2020 | Boland | F26B 13/18 |

* cited by examiner

ADJUSTABLE INTERLACING OF DRYING ROLLERS IN A PRINT SYSTEM

RELATED APPLICATIONS

This document is a continuation of co-pending U.S. patent application Ser. No. 16/046,321 (filed on Jul. 26, 2018) titled, "ADJUSTABLE INTERLACING OF DRYING ROLLERS IN A PRINT SYSTEM," which is a continuation of prior U.S. patent application Ser. No. 15/431,546 (filed on Feb. 13, 2017 and issued as U.S. Pat. No. 10,060,675) titled, "ADJUSTABLE INTERLACING OF DRYING ROLLERS IN A PRINT SYSTEM," which is a continuation of prior U.S. patent application Ser. No. 14/693,020 (filed on Apr. 22, 2015 and issued as U.S. Pat. No. 9,605,900 on Mar. 28, 2017) titled, "ADJUSTABLE INTERLACING OF DRYING ROLLERS IN A PRINT SYSTEM," all of which are hereby incorporated by reference.

FIELD OF THE INVENTION

The invention relates to the field of printing systems, and in particular, to print drying systems.

BACKGROUND

Businesses or other entities having a need for volume printing typically use a production printer capable of printing hundreds of pages per minute. A web of print media, such as paper, is stored the form of a large roll and unraveled as a continuous sheet. During printing, the web is quickly passed underneath printheads which discharge small drops of ink at particular intervals to form pixel images on the web. The web may then be dried and cut to produce a printed product.

In dryers that apply a great deal of heat over a short period of time, it remains a problem to ensure that the print media is properly dried. Too much heat can cause the media to char or burn, while too little heat can result in ink smearing or offsetting that reduces the print quality of jobs. Moreover, other problems in the dryer may occur such as curling or wrinkling of the media due to non-uniform stresses applied to the media during high rates of thermal exchange. Such problems may be amplified as the paper cools in an uncontrolled and non-uniform manner.

SUMMARY

Embodiments described herein provide for adjustable interlacing of drying rollers in a print system. A series of rollers transport a web of media as the media travels in a drying system. One or more of the rollers may be heated to a desired temperature for drying ink recently applied to the media. A first set of rollers transport the web in a first direction, and a second set of rollers transport the web in a second direction, generally opposite to the first direction. The rollers are adjustable such that the first set of rollers and second set of rollers may interlace. When interlaced, the web travels in the second direction in a weaving pattern between the first set of rollers and the second set of rollers to further dry the web as it travels in the second direction.

One embodiment is an apparatus that includes first rollers, at least one of which is configured to conduct heat from a heat source, and dry a web of print media as the web travels over a front side of the first rollers in a first direction. A last roller of the first rollers turns the web in a second direction. The apparatus also includes second rollers disposed a distance above the first rollers and that transport the web in the second direction. The apparatus further includes a movement mechanism that reduces the distance between the second rollers and the first rollers to cause the second rollers to occupy spaces between the first rollers so that the web traveling in the second direction contacts a back side of the first rollers to further dry the web.

Another embodiment is a system that includes a dryer of a print system. The dryer includes first rollers configured to transport a web of print media along a first path. At least one of the first rollers is configured to heat the web to dry ink applied on the web. The dryer also includes second rollers configured to transport the web of print media along a second path above the first path. The system also includes a controller configured to direct a movement mechanism to adjust the second rollers with respect to the first rollers in a direction perpendicular to a traveling direction of the web.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
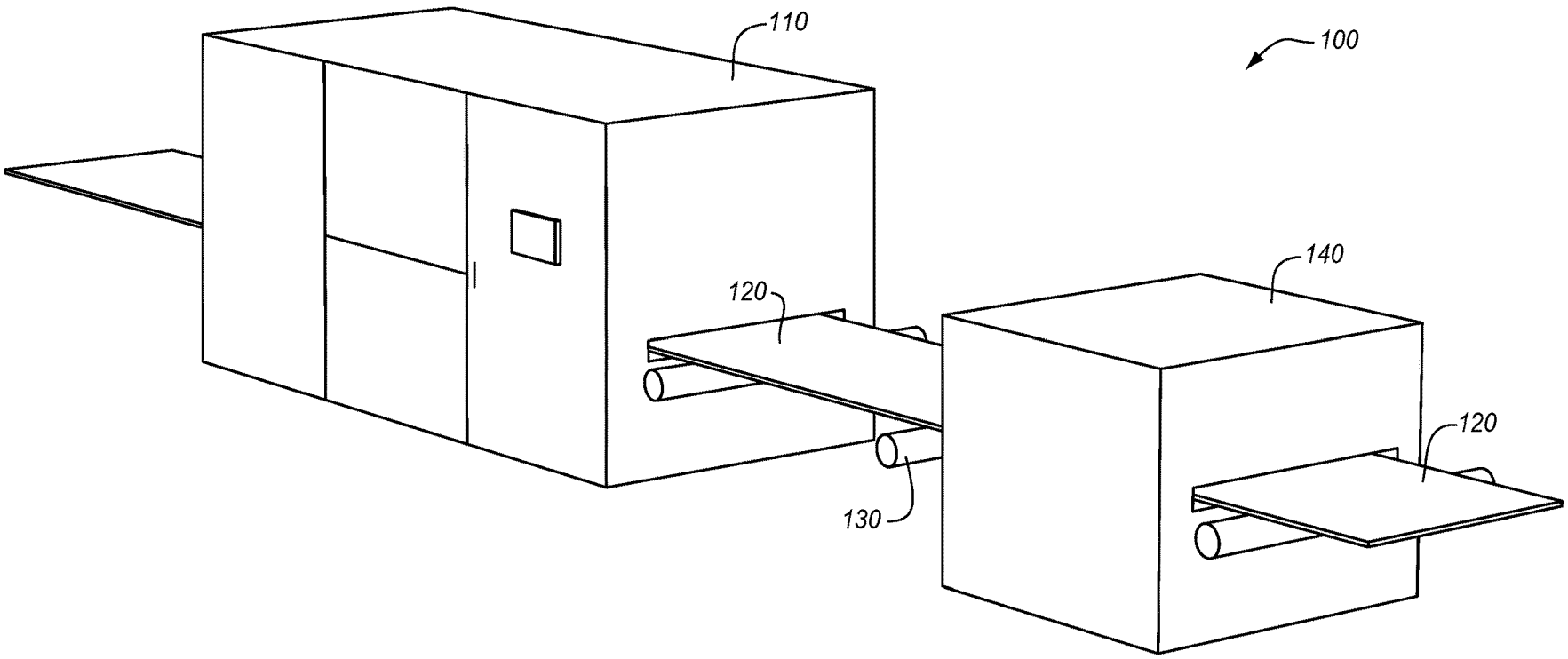
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or clear inks. The ink applied by printer 110 onto web 120 is wet, meaning that the ink may smear if it is not dried before further processing. One or more rollers 130 position web 120 as it travels through printing system 100. Printing system 100 also includes drying system 140, which is any system, apparatus, device, or component operable to dry ink applied to web 120.

Figure 2:
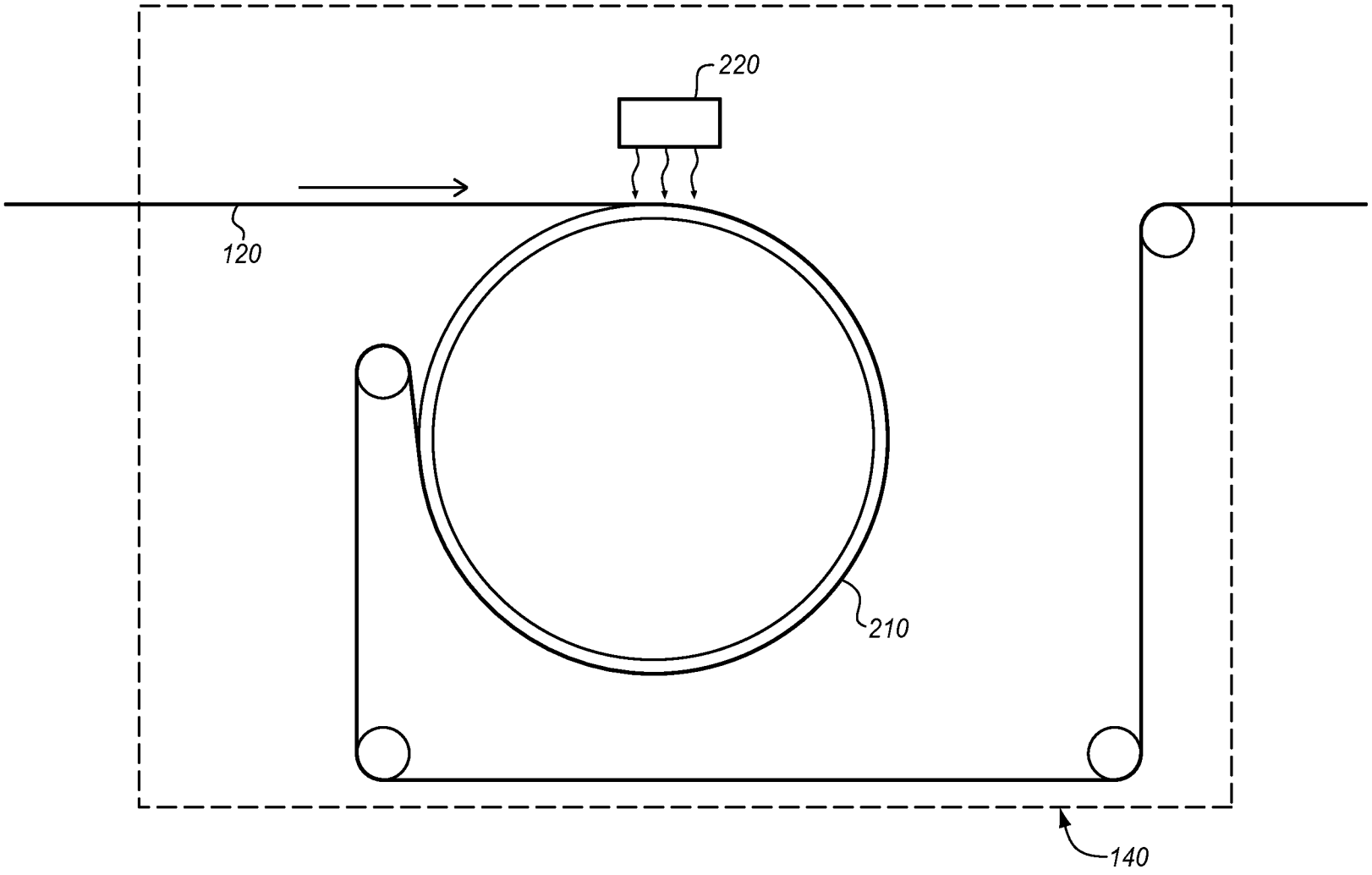
FIG. 2 illustrates a drying system in an exemplary embodiment.

FIG. 2 illustrates a drying system 140 in an exemplary embodiment. Drying system 140 includes a drum 210 and a radiant energy source 220. During operation, web 120 is marked with ink by a print engine, enters drying system 140, and wraps around an outer surface of rotating drum 210, which is heated to a desired temperature via heat transfer of radiant energy source 220. Radiant energy source 220 is any system, component, device, or combination thereof operable to radiate heat to drum 210. One example of a radiant energy source 220 is an array of heat lamps that emit infrared (IR) or near-infrared (NIR) energy and heat.

Conventional drying systems typically include one large drying drum for drying ink applied to the web. In these systems, there is a relatively low degree of control for adjusting temperatures applied to the web of print media because the circumferential section of the drum which contacts the web is constant. Previous systems are thus limited to adjusting the output of the energy source to increase or decrease the temperature of the drum and the heat applied to the web.

Figure 3:
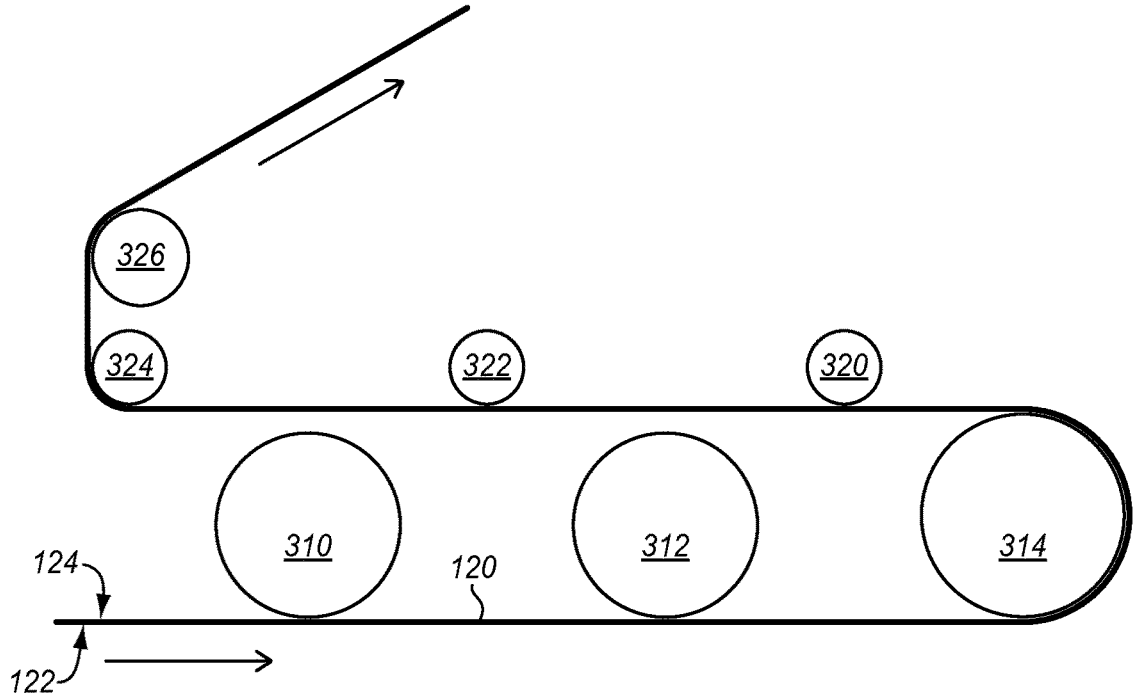
FIG. 3 illustrates a side view of a drying system with a series of rollers in an exemplary embodiment.

Drying system 140 is therefore enhanced with a series of rollers for increased control of drying temperatures applied to web 120. FIG. 3 illustrates a side view of a series of rollers for drying web 120 in an exemplary embodiment. After printing, web 120 enters drying system 140 with a marked side 122 that is wet with an applied ink, and an unmarked side 124 that does not have wet ink. Web 120 is tensioned over a series of rollers 310-326 which rotate for transportation of web 120 in drying system 140 in the arrow direction shown in FIG. 3. One or more rollers 310-326 is heated (e.g., with radiant energy source 220, not shown in FIG. 3) for drying ink applied to web 120.

In general, the individual size of rollers 310-326 is small in comparison to the single large drum dryer of that previously described. Rollers 310-326 may collectively occupy a space with a smaller footprint than that of a large drum dryer. Moreover, as will be apparent in the description to follow, drying system 140 may include various arrangements and numbers of rollers 310-326 for precise drying control of web 120 in a compact space within drying system 140.

As shown in FIG. 3, rollers 310-326 are generally comprised of a first series of rollers 310-314 and a second series of rollers 320-326. The first series of rollers 310-314 receive web 120 at the entrance of drying system 140 and transport web 120 in a first direction (e.g., left to right in FIG. 3). A turning roller 314, which is the last to receive web 120 in the first series of rollers 310-314, reverses the travelling direction of web 120. The second series of rollers 320-326 receive web 120 from turning roller 314 and transport web 120 in a second direction (e.g., right to left in FIG. 3), which is opposite to the first direction. An exit roller 326, which is the last to receive web 120 in the second series of rollers 320-326, may turn the travelling direction web 120 before it exits drying system 140.

The second series of rollers 320-326 are generally disposed in drying system 140 above the first series of rollers 310-314. As such, as web 120 travels in the second direction (e.g., right to left in FIG. 3), web 120 travels above but does not contact the first series of rollers 310-314. For increased control in drying web 120, drying system 140 may be further enhanced to interlace the first series of rollers 310-314 and the second series of rollers 320-326.

Figure 4:
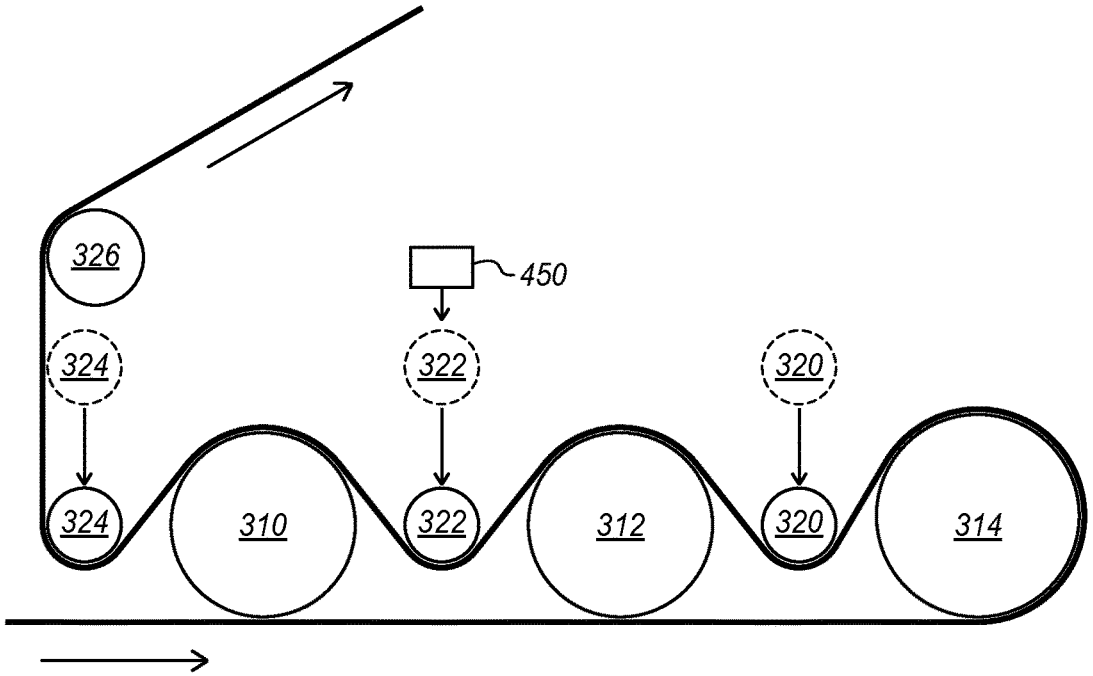
FIG. 4 illustrates a side view of a drying system with a series of rollers in an interlaced configuration in an exemplary embodiment.

FIG. 4 illustrates a side view of a drying system with a series of rollers in an interlaced configuration in an exemplary embodiment. When rollers 310-326 of drying system 140 are in the interlaced configuration, web 120 contacts the first series of rollers 310-314 as it travels in the second direction. Drying system 140 is therefore operable to vary the amount of heated surface contact of web 120.

Interlacing of rollers 310-326 refers to a positional relationship between roller(s) that rotate in opposite direction as web 120 travels from an entrance to an exit of drying system 140. Drying system 140 is configured to adjust these positional relationships to cause a corresponding adjustment in heat applied to web 120. Thus, drying system 140 may include a movement mechanism 450 that is any system, device, apparatus, or combination thereof to adjust a distance of one or more of the first series of rollers 310-314 relative to one or more of the second series of rollers 320-326. Examples of movement mechanism 450 include, but is not limited to, a pneumatic device, a hydraulic device, a motor, an electric linear actuator, etc. Movement mechanism 450 may be mechanically coupled to the first series of rollers 310-314, the second series of rollers 320-326, or both.

Figure 5A:
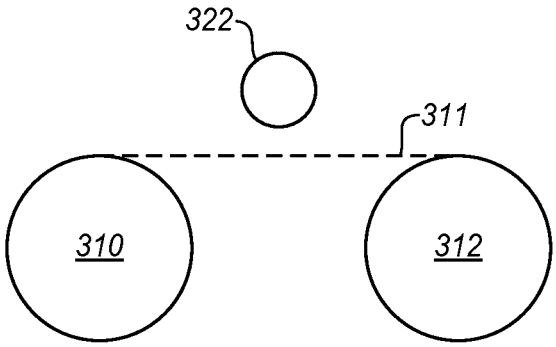
FIG. 5A illustrates rollers of a drying system in a non-interlaced position in an exemplary embodiment.
Figure 5B:
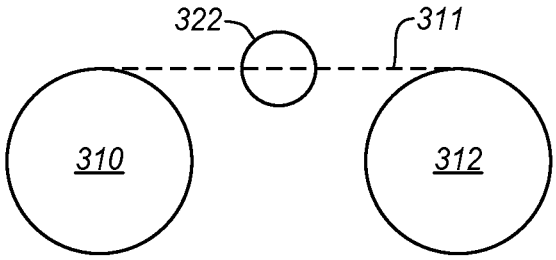
FIG. 5B illustrates rollers of a drying system in a slightly interlaced position an exemplary embodiment.
Figure 5C:
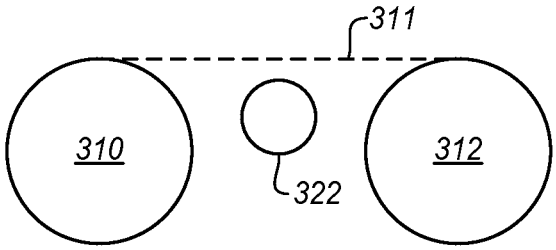
FIG. 5C illustrates rollers of a drying system in a substantially interlaced position in an exemplary embodiment.

FIGS. 5A-5C illustrate various positions of oppositely rotating rollers in drying system 140. Suppose, for example, that adjacent rollers 310-312 are heated and rotate in a counter-clockwise direction for transportation of web 120 in a first direction through drying system 140. Suppose further that roller 322 rotates in a clockwise direction for transportation of web 120 in a second direction through drying system 140. The amount of interlacing between oppositely rotating rollers may be described with respect to a boundary 311 that connects to adjacent rollers 310-312. The boundary 311 may be thought of as a tangential line that connects to outer circumferences of two adjacent rollers operable to transport web 120 one after the other in the same direction, the line being orthogonal to each of the radiuses of the adjacent rollers.

FIG. 5A illustrates rollers of a drying system in a non-interlaced position in an exemplary embodiment. In the non-interlaced position, roller 322 is generally disposed some distance above the boundary 311. Therefore, roller 322 does not press web 120 to contact adjacent rollers 310-312 as web 120 travels in the second direction.

FIG. 5B illustrates rollers of a drying system in a slightly interlaced position an exemplary embodiment. The rollers may be referred to as being in an interlaced position when a roller that rotates in drying system 140 in one direction (e.g., roller 322) intersects or crosses the boundary line 311 of a roller that rotates in drying system 140 in another direction (e.g., rollers 310-312) or vice versa. In the interlaced position, roller 322 presses web 120 to contact adjacent rollers 310-312 as web 120 travels in the second direction.

Drying system 140 is configured to control the amount of heat applied to web 120 as it travels in the second direction by controlling the amount by which an oppositely rotating roller crosses past the boundary line 311. In the slightly interlaced position as shown in FIG. 5B, roller 322 is moved a relatively small distance past the boundary line 311 and into spaces between rollers 310-312. Thus, a relatively small circumferential portion of rollers 310-312 contact web 120 as it travels in the second direction and a correspondingly small increase of heat is applied to web 120 in drying system 140.

FIG. 5C illustrates rollers of a drying system in a substantially interlaced position in an exemplary embodiment. In this position, roller 322 is moved a relatively large distance past the boundary line 311 and into spaces between rollers 310-312. As web 120 travels in the second direction, the position of roller 322 presses web 120 downward to cause it to wrap around a larger circumferential portion of rollers 310-312 for increased heat applied to web 120.

Thus, for a relatively large increase in heat applied to web 120, drying system 140 may interlace multiple rollers by moving rollers that rotate one direction (e.g., the second series of rollers 320-324) to occupy spaces between multiple rollers that rotate in another direction (e.g., the first series of rollers 310-314) at relatively large distances past the interlacing boundary lines for an increased wrap angle and therefore increased heated contact between web 120 and the back side of the first series of rollers 310-314. Alternatively, for a smaller increase in heat applied to web 120, drying system 140 may interlace fewer rollers and/or interlace rollers at relatively small distances past the interlacing boundary lines.

Printing system 100 and/or drying system 140 may further include a controller for directing the movement mechanism 450 to position rollers based on drying conditions, web properties, ink amounts, operator input, etc. Printing system 100 or drying system 140 may also include a graphical user interface to receive operator input or instructions for directing the controller. The graphical user may display an amount of interlacing between one or more rollers of drying system 140 and/or display a current status indicative of whether rollers in drying system 140 are interlaced or non-interlaced.

The controller may direct movement mechanism 450 to disengage one or more rollers of drying system 140 to a non-interlaced position responsive to input, instructions, or a determination that maintenance procedures are to be performed on drying system (e.g., paper threading and roller cleaning), that transportation of the web 120 is to halt, that a period of non-printing is to occur (e.g., to prevent curling of web 120 when web is stationary between interlaced rollers), or that additional drying of web 120 is unnecessary. Alternatively or additionally, the controller may direct movement mechanism to engage one or more rollers of drying system 140 to an interlaced position in response to operator input, instructions, or a determination that increased drying of web 120 is desirable. For example, controller may direct movement mechanism 450 to adjust the wrap angle or the amount of interlacing between one or more rollers to cause a corresponding increase or decrease in heat applied to web 120 in response to instructions received at the graphical user interface.

Figure 6:
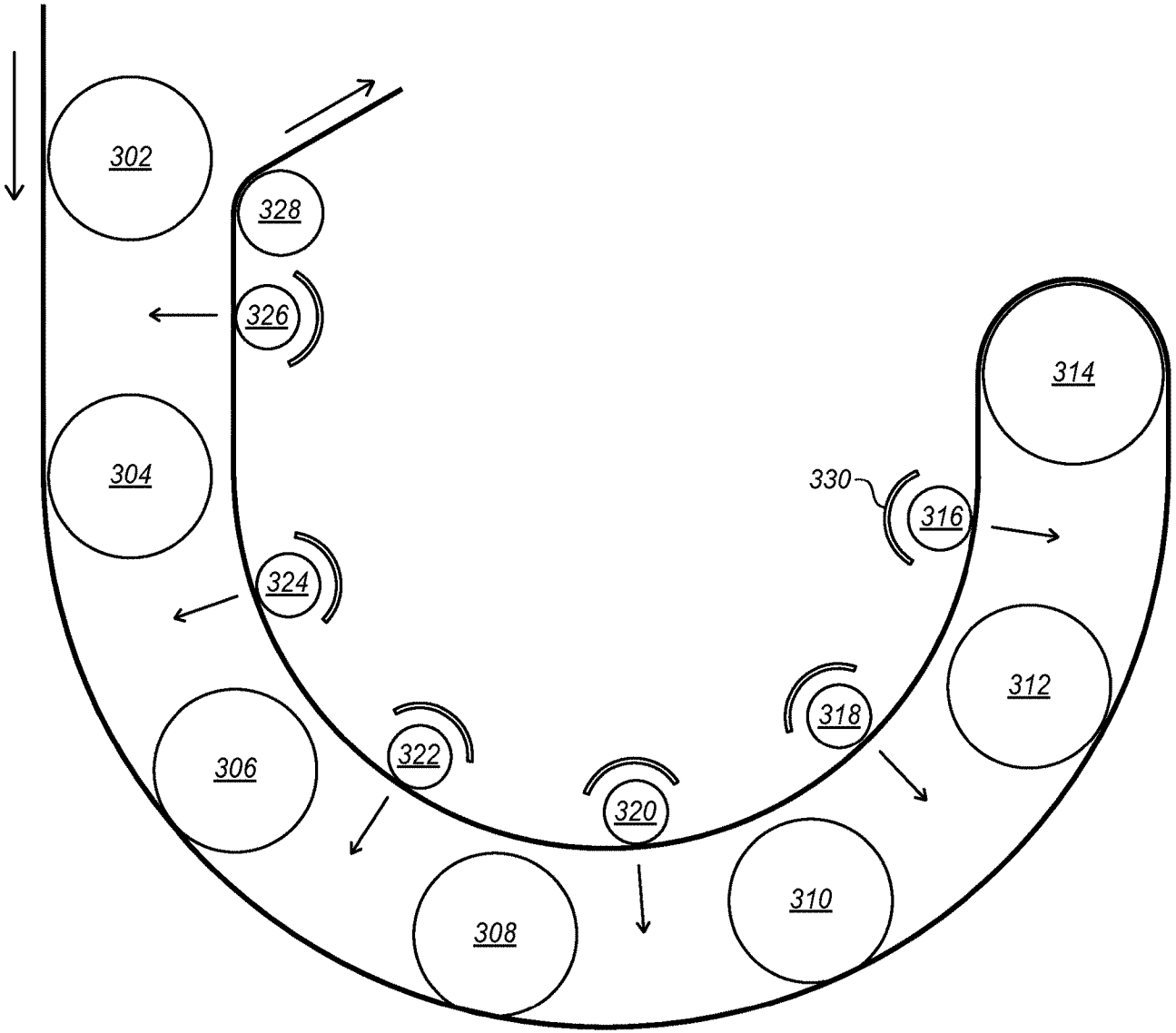
FIG. 6 illustrates a side view of a drying system with a series of rollers in another exemplary embodiment.

FIG. 6 is a side view of drying system 140 with a series of rollers in another exemplary embodiment. FIG. 6 shows that rollers (e.g., rollers 302-328) of drying system 140 may be configured to transport web 120 over several heat-adjustable surfaces in a compact space. A first series of rollers 302-314 rotate counter-clockwise and are disposed in drying system 140 in a semi-circular pattern. A second series of rollers 316-328 rotate clockwise and are disposed in a semi-circular pattern above the first series of rollers 302-314. One or more rollers 302-328 may have an associated reflective material 330 coupled therewith or disposed nearby to reflect radiated heat back toward web 120 for increased heating efficiency.

Figure 7:
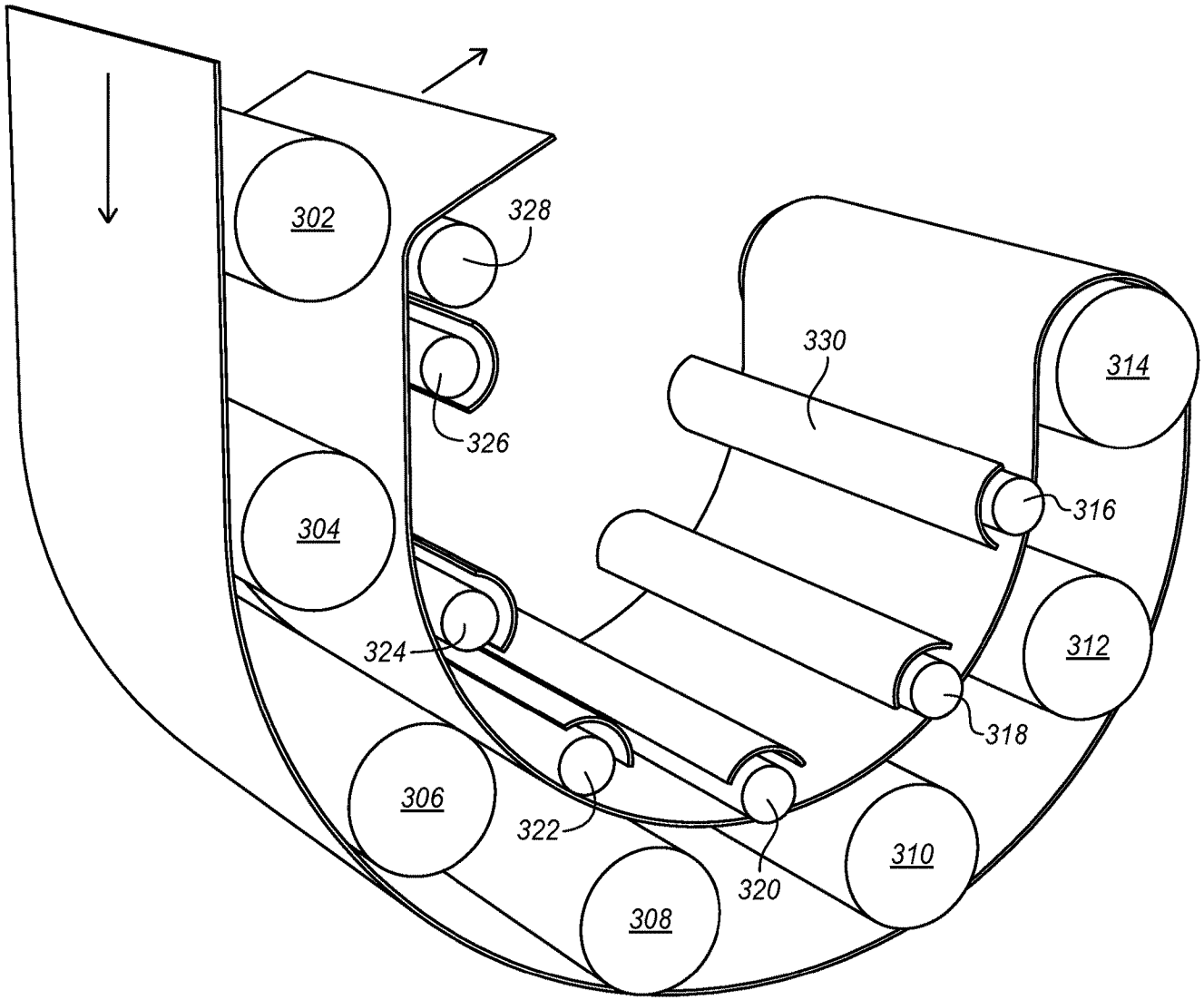
FIG. 7 illustrates a perspective view of a drying system with a series of non-interlaced rollers in another exemplary embodiment.
Figure 8:
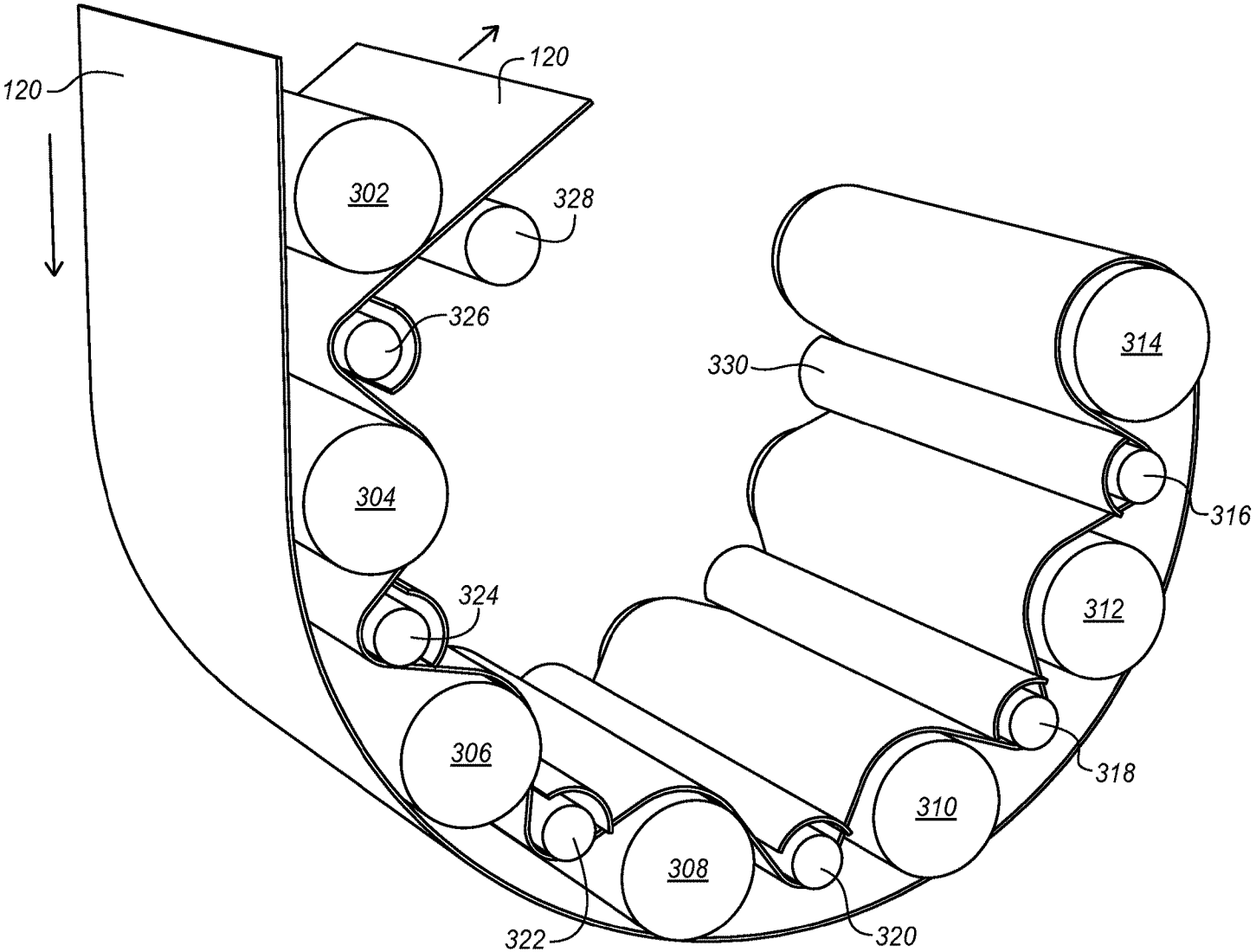
FIG. 8 illustrates a perspective view of a drying system with a series of interlaced rollers for adjusting the drying of a web in another exemplary embodiment.

Drying system 140 is configured to adjust the relative positions between one or more the first series of rollers 302-314 and one or more of the second series of rollers 316-328 to various interlacing or non-interlacing positions for optimal drying control of web 120. FIG. 7 is a perspective view of drying system 140 with a series of non-interlaced rollers in another exemplary embodiment. FIG. 8 is a perspective view of drying system 140 with a series of interlaced rollers in another exemplary embodiment.

Since rollers 302-328 of FIGS. 6-8 are disposed in drying system 140 in curved patterns, drying system 140 may be configured to adjust individual interlacing positions of rollers in various directions that are perpendicular to the curved travelling path of web 120. For example, at least some of the second series of rollers 316-328 may be offset from the first series of rollers 302-314 with respect to a direction parallel with the travelling direction of web 120. Drying system 140 adjusts contact drying of web 120 by moving the offset, oppositely rotating rollers into spaces between one another in a direction perpendicular to the travelling direction of web 120.

When not interlaced, the second series of rollers 316-328 are disposed a distance from the first series of rollers 302-314 in a direction orthogonal to the travelling direction of web 120 when drying system 140. As web enters drying system 140, the unmarked side 124 of web 120 contacts a portion of the outer circumference of each of the first series of rollers 302-314 which transport web 120 in a forward curved path. The circumferential portion of each of the first series of rollers 302-314 which contact web 120 in the forward direction may be referred to herein as a front side of rollers 310-314. The second series of rollers 316-328 transport web 120 in a reverse curved path above the first series of rollers 302-314.

Though ink applied to the marked side 122 of web 120 may be sufficiently dry so as not to smear by the time it reaches and contacts the second series of rollers 316-328, it may be desirable for a number of reasons to further transfer heat to web 120 for sufficient print quality. To adjust the amount of heat applied to web 120, drying system 140 interlaces one or more rollers 302-328 as described above. As such, a movement mechanism 450 may increase or decrease the distance between one or more of the second series of rollers 316-328 and one or more of the first series of rollers 302-314.

When interlaced, the distance between the second series of rollers 316-328 and the first series of rollers 302-314 is decreased. The unmarked side 124 of web 120 contacts a portion of the outer circumference of each of the first series of rollers 302-314 as web 120 travels generally in the reverse direction but which now interleaves in a zigzag pattern between the second series of rollers 316-328 and the first series of rollers 302-314. The circumferential portion of each of the first series of rollers 310-314 which contact web 120 in the reverse direction may be referred to herein as a back side of rollers 310-314.

Thus, when drying system 140 is configured with interlaced rollers, web 120 is heated via front side contact of each of the first series of rollers 302-314 in the forward direction, and web 120 is further heated via contact with the back side of each of the first series of rollers 302-314 as web 120 travels in the reverse direction. Thus, the total amount of contact between web 120 and the first series of rollers 302-314 in drying system 140 is increased and the total heat applied to web 120 is therefore also increased in comparison to when drying system 140 is configured with non-interlaced rollers.

Figure 9:
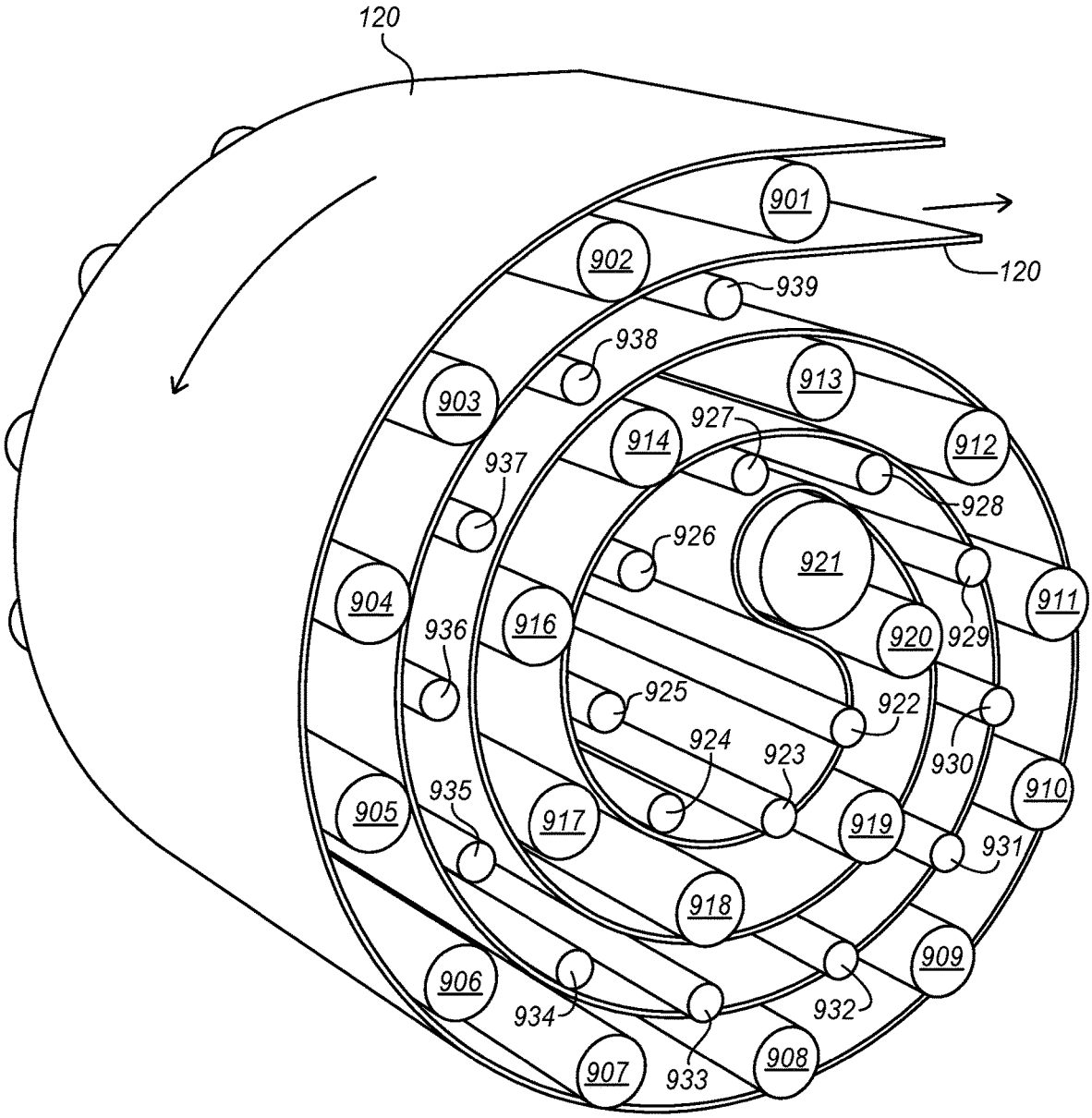
FIG. 9 illustrates a perspective view of a drying system with a series of non-interlaced rollers in another exemplary embodiment.
Figure 10:
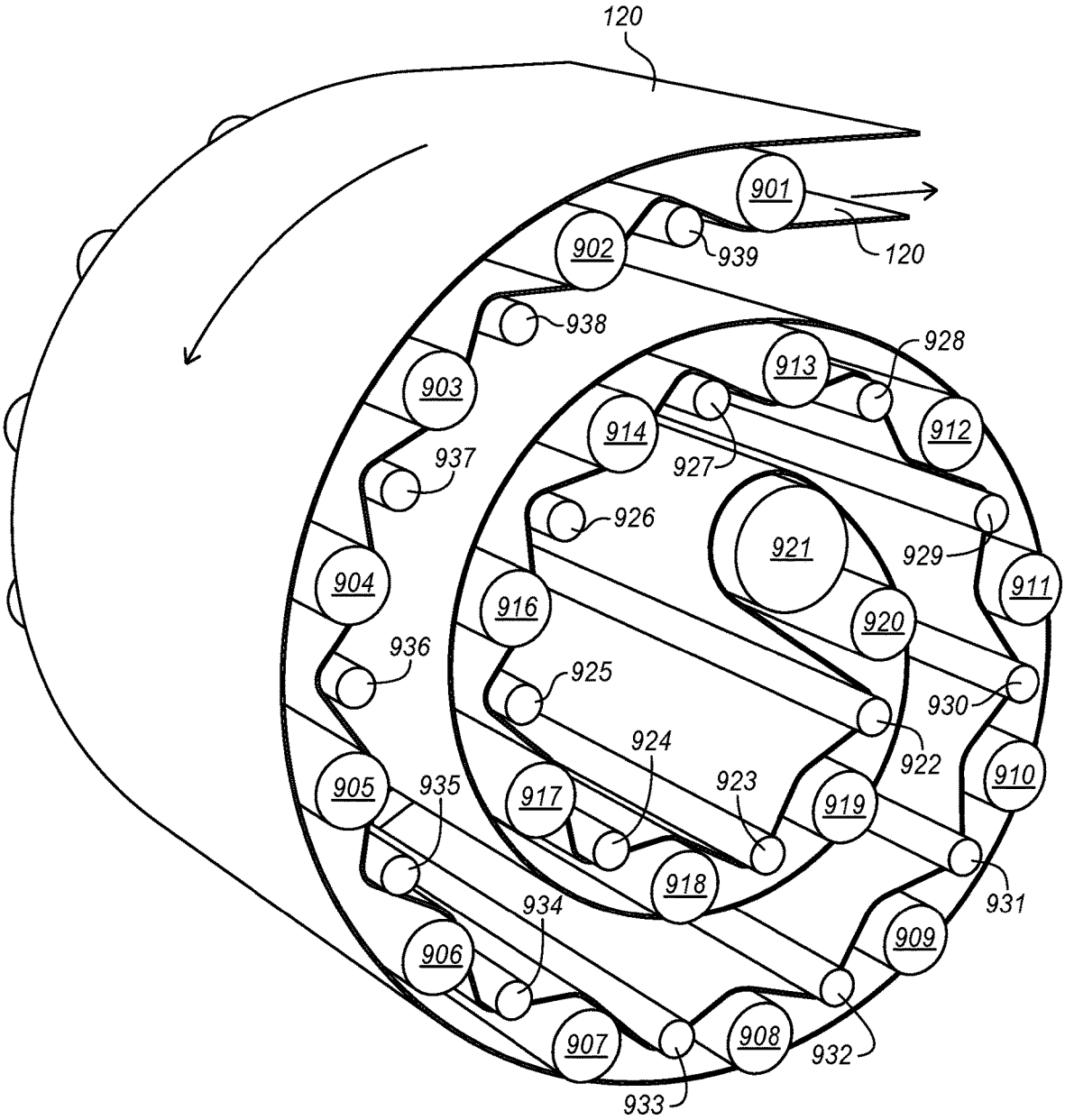
FIG. 10 illustrates a perspective view of a drying system with a series of interlaced rollers in another exemplary embodiment.

FIG. 9 is a perspective view of drying system 140 with a series of rollers in yet another exemplary embodiment. FIG. 10 is a perspective view of drying system 140 with a series of rollers in an interlaced position in yet another exemplary embodiment. As shown in FIGS. 9-10, rollers 901-939 are positioned in drying system 140 in a spiral pattern. The spiral pattern of rollers 901-939 increases the number of heat contactable surfaces for web 120 in drying system 140 in a relatively compact space.

Suppose, for example, that the first series of rollers 901-921 are heated and transport web 120 in a forward direction along a first spiral path. Suppose further that the second series of rollers 922-939 are at ambient temperature and transport web 120 in a reverse direction along a second spiral path inside the first spiral path. As web 120 enters drying system 140 and travels in the forward direction, a high degree of control for drying web 120 is possible (e.g., in comparison to a single drum dryer) since surfaces of each of the first series of rollers 901-921 may be heated separately to various temperatures. No further heat is applied to web 120 via contact between web 120 and the first series of rollers 901-921 after web 120 turns directions at roller 921 to travel in the reverse direction when rollers 901-939 are in a non-interlaced configuration. Drying system 140 may adjust the engagement amount between the first series of rollers 901-921 and the second series of rollers 922-939 in a direction orthogonal to the spiral pattern to cause a corresponding adjustment in heat transferred to web 120 via the first series of rollers 901-921.

Rollers of drying system 140 may transfer thermal energy in a variety of configurations. For instance, rollers may be heated, cooled, or ambient in temperature in any number of combinations to provide desired conditioning of web 120. Also, rollers of drying system 140 may be driven and/or idle in any number of configurations. Heated rollers may include a radiant energy source, such as radiant energy source 220, disposed inside a hollow circumference of rollers 310-326 and/or disposed outside an external surface of rollers 310-326. In one embodiment, one or more of the first series of rollers are heated and one or more of the second series of rollers are ambient or cooled. The controller that directs movement mechanism 450 may be configured with information regarding which rollers are heated, ambient, or cooled to controllably adjust the rate at which web 120 is heated and/or cooled in drying system 140.

Although specific embodiments were described herein, the scope of the inventive concepts is not limited to those specific embodiments. The scope of the inventive concepts is defined by the following claims and any equivalents thereof.

We claim:

1. An apparatus comprising:

a heat roller to heat a web, the heat roller including:

a first circumferential portion contacting the web in a first traveling path; and a second circumferential portion contacting the web in a second traveling path, wherein the first circumferential portion and the second circumferential portion are circumferentially separate from each other.

2. The apparatus of claim 1 wherein the heat roller further includes:

a third circumferential portion not contacting the web; and a fourth circumferential portion not contacting the web, wherein the third circumferential portion and the fourth circumferential portion are circumferentially separate from each other.

3. The apparatus of claim 2 wherein:

the third circumferential portion is located adjacent to the first circumferential portion and the second circumferential portion, and the fourth circumferential portion is located adjacent to the first circumferential portion and the second circumferential portion.

4. The apparatus of claim 1 further comprising:

a turning device configured to receive the web from the first traveling path and to guide the web towards the second traveling path.

5. The apparatus of claim 4 wherein:

the turning device heats the web.

6. The apparatus of claim 4 further comprising:

a support to contact a second side of the web in the second traveling path, wherein the first circumferential portion contacts a first side of the web, and wherein the second circumferential portion contacts the first side of the web.

7. The apparatus of claim 6 wherein:

the support is located between the turning device and the heat roller.

8. The apparatus of claim 1 wherein:

the heat roller is one of a plurality of heat rollers.

9. The apparatus of claim 8 wherein:

the plurality of heat rollers are arranged to form an arc.

10. The apparatus of claim 9 further comprising:

a turning device configured to receive the web from the first traveling path and to guide the web towards the second traveling path; and a support to contact the second side of the web in the second traveling path, wherein the first circumferential portion contacts a first side of the web and the second circumferential portion contacts the first side of the web.

11. The apparatus of claim 8 further comprising:

a turning device configured to receive the web from the first traveling path and to guide the web towards the second traveling path, wherein the plurality of heat rollers are arranged around the turning device.

12. The apparatus of claim 1 further comprising:

an inkjet printer configured to apply ink to the web.

13. The apparatus of claim 1 wherein:

the heat roller is a roller including a heated surface to heat the web.

14. The apparatus of claim 1 further comprising:

the first circumferential portion includes a heated surface.

15. The apparatus of claim 1 further comprising:
the second circumferential portion includes a heated surface.

16. The apparatus of claim 1 further comprising:
a heat source disposed outside the heat roller.

17. The apparatus of claim 1 further comprising:
a heat source disposed inside the heat roller.

18. An apparatus comprising:
a roller contacting a web, the roller including:
a first circumferential portion contacting the web in a first traveling path; and
a second circumferential portion contacting the web in a second traveling path,
wherein the first circumferential portion and the second circumferential portion are circumferentially separate from each other, and
wherein heat transfer occurs between the web and the first circumferential portion.

19. The apparatus of claim 18 wherein:
heat transfer occurs between the web and the second circumferential portion.

20. The apparatus of claim 18 further comprising;
a heat source disposed outside the roller.

21. The apparatus of claim 18 further comprising:
a heat source disposed inside the roller.

22. An apparatus comprising:
a roller including a heated surface, the roller contacting a web, and the roller including:
a first circumferential portion contacting the web in a first traveling path; and
a second circumferential portion contacting the web in a second traveling path,
wherein the first circumferential portion and the second circumferential portion are circumferentially separate from each other.

23. The apparatus of claim 22 further comprising:
at least one of the first circumferential portion and the second circumferential portion includes the heated surface.

24. The apparatus of claim 22 further comprising:
a heat source disposed outside the roller.

25. The apparatus of claim 22 further comprising:
a heat source disposed inside the roller.

26. The apparatus of claim 18 further comprising:
an inkjet printer configured to apply ink to the web.

27. The apparatus of claim 22 further comprising:
an inkjet printer configured to apply ink to the web.

* * * * *